United States Patent [19]

Ward et al.

[11] 4,409,372

[45] Oct. 11, 1983

[54] PAINT BRUSH BRISTLES

[75] Inventors: John Ward, Crofton; Robert E. Austin, Crownsville, both of Md.

[73] Assignee: Ametek, Inc., Odenton, Md.

[21] Appl. No.: 340,914

[22] Filed: Jan. 20, 1982

[51] Int. Cl.[3] ..... D02G 3/00

[52] U.S. Cl. ..... 525/425; 428/364; 428/398; 428/399

[58] Field of Search ..... 428/364, 373, 475.5, 428/398, 399; 260/DIG. 32, DIG. 23; 525/425; 15/159 A

[56] References Cited

U.S. PATENT DOCUMENTS 4,307,478 12/1981 Ward et al. ..... 15/159 A

FOREIGN PATENT DOCUMENTS 1242700 8/1971 United Kingdom ..... 525/425

*Primary Examiner*—George F. Lesmes
*Assistant Examiner*—E. Rollins Buffalow
*Attorney, Agent, or Firm*—Karl W. Flocks; Sheridan Neimark

[57] ABSTRACT

Improved paint brush bristles and provided from a blend of nylon 6/6 or nylon 6/12, together with between 4–15%, depending upon the shape and size of the filament, of a co-polyester derived from terephthalic and isophthalic acids with cyclohexane dimethanol.

2 Claims, No Drawings

PAINT BRUSH BRISTLES

FIELD OF INVENTION

The present invention relates to paint brush bristles and more particularly to paint brush bristles formed of nylon/polyester blends.

BACKGROUND

Synthetic paint brush bristles have been made for many years and from various materials, including, most importantly, polyester and nylon. While very good paint brush bristles are made from the commonly used materials, two significant problems continue to exist: the first is that many of the best materials, such as nylon 6/12, are simply too expensive for all but the finest and most expensive paint brushes; the second is properties of the commonly used materials do not, in general, make the best bristles in all regards, and there is a need to provide a composition, at a relatively low cost, which will provide paint brush bristles of excellent quality.

Specifically, the paint brush industry has become highly sensitized to certain characteristics of the bristle which can improve bristle energy (bristle "snapback"), straightness, better registration and size control, improved tipability, and softness of the tips after the finishing operation. Nylon 6.12 is the generally accepted base material for nylon paint brush bristles throughout the industry; however, the 6/12 resin price increases in the past several years have created a dire need for a more price competitive nylon, especially in the middle and low end brush lines.

On the other hand, nylon 6/6 is generally not used as a paint brush bristle due to its high inherent curl and poor finish characteristics. This is particularly true of the hollow bristle, both tapered and untapered, which constitute the major quantity of bristles used today.

SUMMARY

It is, accordingly, an object of the invention to overcome the deficiencies of the prior art, such as indicated above.

It is another object to provide for improved paint brush bristles.

It is another object to provide for less expensive, high quality, paint brush bristles.

These and other objects and the nature and advantages of the instant invention will be more apparent from the following description of embodiments of the instant invention. Generally, however, it has been discovered that the addition of limited and controlled amounts of a co-polyester derived from terephthalic acid and isophthalic acid, condensed with cyclohexane dimenthanol, solves the aforementioned problems and meets the objectives of the invention.

DETAILED DESCRIPTION OF EMBODIMENTS

In general, nylons and polyesters, particularly those used in the paint brush bristle industry, are not accepted as being compatible with one another. In particular, Kodar A150 (a co-polyester derived from terephthalic acid and isophthalic acid with cyclohexane dimethanol) is not generally accepted as a resin which is compatible with nylons, and indeed it is incompatible over all but a small range.

It has now been discovered that by adding limited and controlled amounts of Kodar A150 to nylon 6/6, i.e. between 4 and 15% depending upon the shape and size of the bristle being produced, an improved paint brush bristle has been provided which has high quality. Whereas, nylon 6/6 in the past has been generally unsatisfactory because of its high inherent curl and poor finish characteristics, it has now been discovered that the addition of the aforementioned polyester overcomes the disadvantages; thus, it is theorized that the Kodar A150 in admixture in the quantities mentioned above serves as a buffer to erratic molecular curing stresses inherent with nylon 6/6 and returns the bristles to the straight right configuration required for brush making. This phenomenon takes place during the bristle curing operation, within approximately 3–9 days after extrusion of the bristle. The nylon and the co-polyester are compatible over only a very limited range and within that range produce the desired results only within the narrower range of 4–15% as indicated above.

Premium tapered brush lines can stand the higher based resin price of nylon 6/12 at least at present. However, we have now made a dramatic improvement in the physical properties of the nylon 6/12 bristle with the controlled addition of Kodar A150. By adding the limited and controlled amounts of Kodar A150 to the nylon 6/12, again between 4–15% depending upon the shape and size of the filament, we have produced highly significant improvements in the extrusion characteristics of the bristle, including better registration (uniformity of a group of bristles used to form a brush, particularly important for hollow tapered bristles, noting U.S. Pat. No. 4,307,478), a remarkable improvement in bristle energy (bristle "snapback"), finish (flag and tip) and the surface texture of the bristle shank, all of such properties being important for the highest quality bristles.

The aforementioned compositions can be used to form all types of paint brush bristles including solid level, hollow level, solid tapered and hollow tapered. The formation techniques are those now commonly known, the components of the blend being added to the extruder upstream of the spinnerette and uniformly mixed therein to form a homogeneous blend prior to extrusion from the spinnerette.

It is important to understand that selection of the polyester is very important. Not all polyesters will produce the improved results of the instant invention and, so far, only co-polyesters derived from terephthalic and isophthalic acids with cyclohexane diemthanol have proven successful.

The foregoing description of specific embodiments will so fully reveal the general nature of the invention that others can, by applying current knowledge, readily modify and/or adapt such specific embodiments without departing from the generic concept and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. Paint brush bristles formed of a compatible blend of nylon 6/6 and 4–15% (based on the total quantity of resin) of a co-polyester derived from terephthalic and isophthalic acids with cyclohexane dimethanol.

2. Paint brush bristles formed of a compatible blend of nylon 6/12 and 4–15% (based on the total quantity of resin) of a co-polyester derived from terephthalic and isophthalic acids with cyclohexane dimethanol.

* * * * *